US007665626B2

(12) United States Patent
Alvares

(10) Patent No.: US 7,665,626 B2
(45) Date of Patent: Feb. 23, 2010

(54) REMOVABLE LID OF A PAINT CONTAINER

(75) Inventor: Antonio Carlos Teixeira Alvares, Sao Paulo-SP (BR)

(73) Assignee: Brasilata S/A Embalagens Metalicas, Sao Paulo-SP (BR)

( * ) Notice: Subject to any disclaimer, the term of this patent is extended or adjusted under 35 U.S.C. 154(b) by 483 days.

(21) Appl. No.: 10/569,993

(22) PCT Filed: Aug. 25, 2004

(86) PCT No.: PCT/BR2004/000157

§ 371 (c)(1),
(2), (4) Date: Jun. 7, 2006

(87) PCT Pub. No.: WO2005/021287

PCT Pub. Date: Mar. 10, 2005

(65) Prior Publication Data

US 2006/0255034 A1 Nov. 16, 2006

(30) Foreign Application Priority Data

Aug. 29, 2003 (BR) ..... 0303764

(51) Int. Cl.
*B65D 43/03* (2006.01)

(52) U.S. Cl. ..... 220/379; 206/45.28; 220/212; 220/699; 220/700

(58) Field of Classification Search ..... 15/257.05, 15/257.06; 206/508, 45.28; 220/212, 570, 220/695, 697, 700, 832, 835, 379, 571, 571.1, 220/699, 744

See application file for complete search history.

(56) References Cited

U.S. PATENT DOCUMENTS

| | | | | |
|---|---|---|---|---|
| 3,828,389 | A * | 8/1974 | Heisler | 15/257.06 |
| 3,948,413 | A | 4/1976 | Gorrell et al. | |
| 4,341,091 | A * | 7/1982 | Minter | 62/372 |
| 4,799,603 | A * | 1/1989 | Dudzik | 220/789 |
| 5,404,611 | A | 4/1995 | Raney | |
| 5,472,111 | A | 12/1995 | Renfrew | |
| 6,102,235 | A | 8/2000 | Stern et al. | |
| 2002/0014493 | A1 * | 2/2002 | Delmon | 220/836 |

FOREIGN PATENT DOCUMENTS

| | | |
|---|---|---|
| CA | 2 083 935 A1 | 5/1994 |
| DE | 44 32 935 A1 | 3/1995 |
| EP | 0 412 876 A1 | 2/1991 |

* cited by examiner

*Primary Examiner*—Anthony Stashick
*Assistant Examiner*—Elizabeth Volz
(74) *Attorney, Agent, or Firm*—Darby & Darby P.C.

(57) ABSTRACT

A paint container, comprising a body (10) with a polygonal cross section, presenting upper edge portions (13) and a lid (20) having lateral edge portions (21) which are removably seated and tightly retained in a seat (15) defined along the upper edge portions (13) of the body (10). The lid (20) presents a lower face (20*a*) incorporating a downwardly projecting support means (22) which is engaged with an adjacent upper edge portion (13) of the body (10) after the opening of the lid (20), in order to maintain the latter with its adjacent lateral edge portion (21) externally seated against the lateral wall (11) of the body (10) and in an inclined position with its lower face (20*a*) forming a paint drip tray, said support means (22) defining a deflecting chute (25) for directing, to the interior of the body (10), the paint that is gravitationally dripping down the internal face (20*a*) of the lid (20).

15 Claims, 5 Drawing Sheets

REMOVABLE LID OF A PAINT CONTAINER

CROSS REFERENCE TO PRIOR APPLICATION

This is a U.S. national phase application under 35 U.S.C. §371 of International Patent Application No. PCT/BR2004/000157, filed Aug. 25, 2004, and claims benefit of Brazilian Patent Application No. PI 0303764-9, filed Aug. 29, 2003 which is incorporated by reference herein. The International Application was published in English on Mar. 10, 2005 as WO 2005/021287 A3 under PCT Article 21(2).

FIELD OF THE INVENTION

The present invention refers to a container, such as a can, for storing a volume of paint and which is defined by a body superiorly closed by a removable reclosable lid, which is constructed to operate also as a paint drip tray to be used with rollers or other painting instruments which are wetted with paint when directly immersed in the content of the container.

PRIOR ART

The state of the art related to the object of the present invention provides different paint container constructions, according to which the container body is associated with a removable and reclosable lid which is constructed to define, when in the open condition, a paint drip tray.

In U.S. Pat. No. 3,828,389, the lid is formed in a single piece with the body of the container, requiring the utilization of plastic material for the formation of the one-piece body-lid combination, which leads to a relatively high cost construction.

U.S. Pat. No. 6,102,235 proposes the construction of a lid provided with an opening and with a tilting cover which is operatively associated with the opening so as to close and open it, said tilting cover defining, in an open condition, an inclined tray which allows the painter to remove the excess of paint from the paint roller or brush, after immersing them in the paint stored in a container body closed by the lid. This construction is complex and expensive, requiring the formation of a tilting cover in the container lid itself.

U.S. Pat. No. 4,928,843 presents a body and removable lid combination in which the lid carries, on its external face, hinged support means or arms to be fitted in the edge when the lid is mounted in the inverted position, in the form of an inclined tray. Besides complex and expensive, this construction requires the lower edge of the lid-tray to be positioned in the interior of the container body and at least initially immersed in the paint.

U.S. Pat. No. 5,404,611 presents a construction in which the lid, after being removed from its closing position, has its lateral edges fitted in supports internally provided on two opposite lateral walls of the container body, in order to occupy an inclined position in the form of a paint drip tray, the lid being medianly supported by the container handle itself. The provision of the internal lateral supports complicates the construction, even considering the formation of the container body in plastic material. For containers in which the body is made of metallic sheet, this construction is unacceptably complex.

OBJECT OF THE INVENTION

By reason of the disadvantages found in the presently known constructions, it is a generic object of the present invention to provide a paint container comprising a body and a reclosable lid, which are made of metallic or plastic material and present a simple and low cost construction, allowing the lid to be easily opened and mounted to an upper edge of the container body, in order to form a paint drip tray.

SUMMARY OF THE INVENTION

The generic object of the invention, as mentioned above, is attained through a paint container comprising a body with a generally rectangular polygonal cross section defined by lateral walls, whose upper edges define respective upper edge portions of the body; and a lid, having lateral edge portions which are removably seated and retained in a seat defined along the upper edge portions of the body.

According to the invention, the lid presents a lower face incorporating a downwardly projecting support means, which is selectively engaged with an adjacent upper edge portion of the body after the opening of the lid, in order to maintain the latter with its adjacent lateral edge portion externally seated against the respective lateral wall of the body and in an inclined position upwardly and outwardly from the body, with its lower face forming a paint drip tray. The support means defines a deflecting chute, which is configured to direct, to the interior of the body, the paint that is gravitationally dripping down the internal face of the lid.

The construction above allows the lid, which is provided with only one simple lower support means, to be rapidly and easily removed from the body of the container and readapted thereto in an inverted position, utilizing an upper edge portion of the body and one of its lateral walls as elements for supporting and positioning the lid in the inverted inclined position in order to operate as a paint drip tray.

BRIEF DESCRIPTION OF THE DRAWINGS

The invention will be described below, with reference to the enclosed drawings given by way of example of a construction of the invention, and in which.

DETAILED DISCLOSURE OF THE INVENTION

Figure 1:
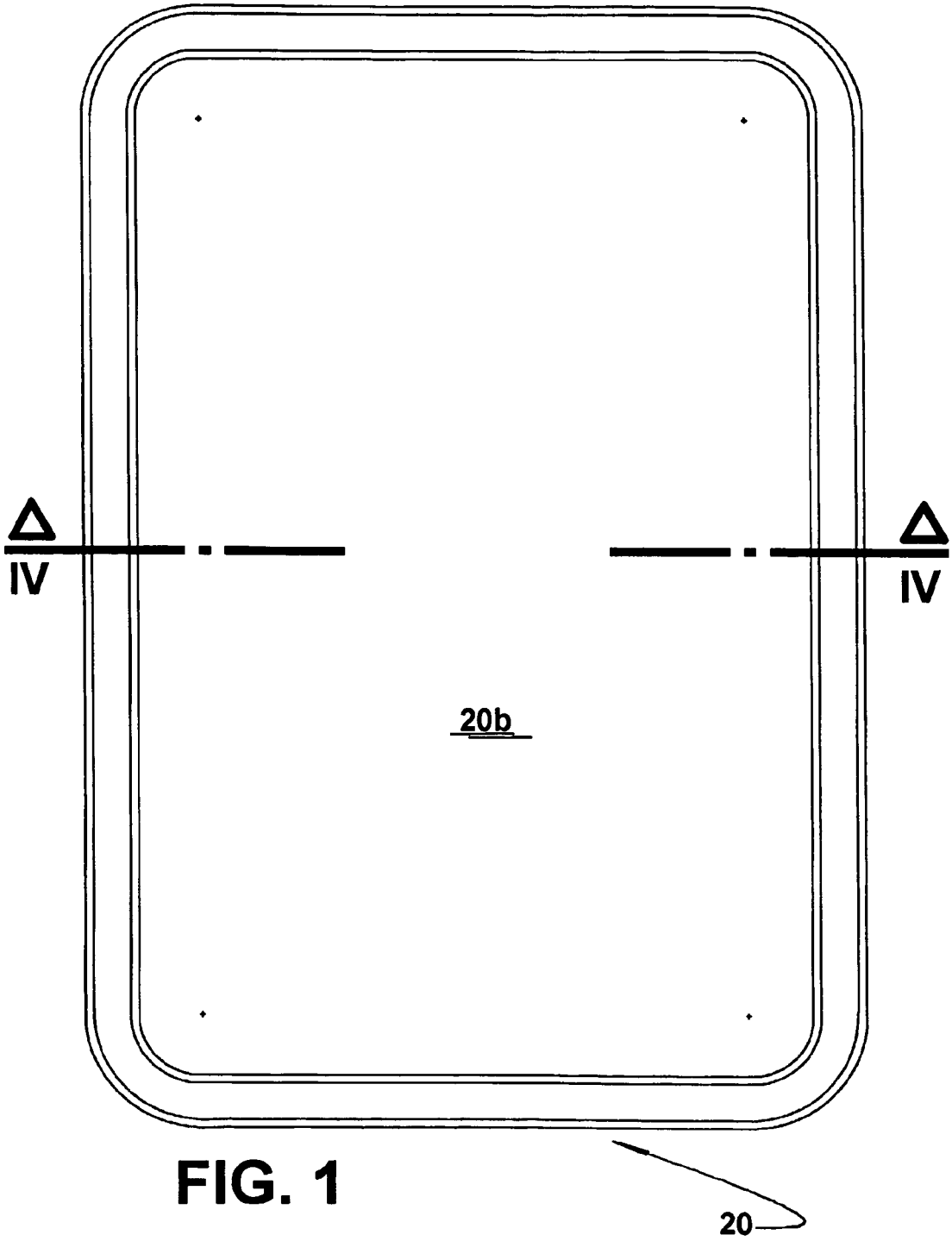
FIG. 1 is an upper plan view of the container with the lid in the closed position.
Figure 2:
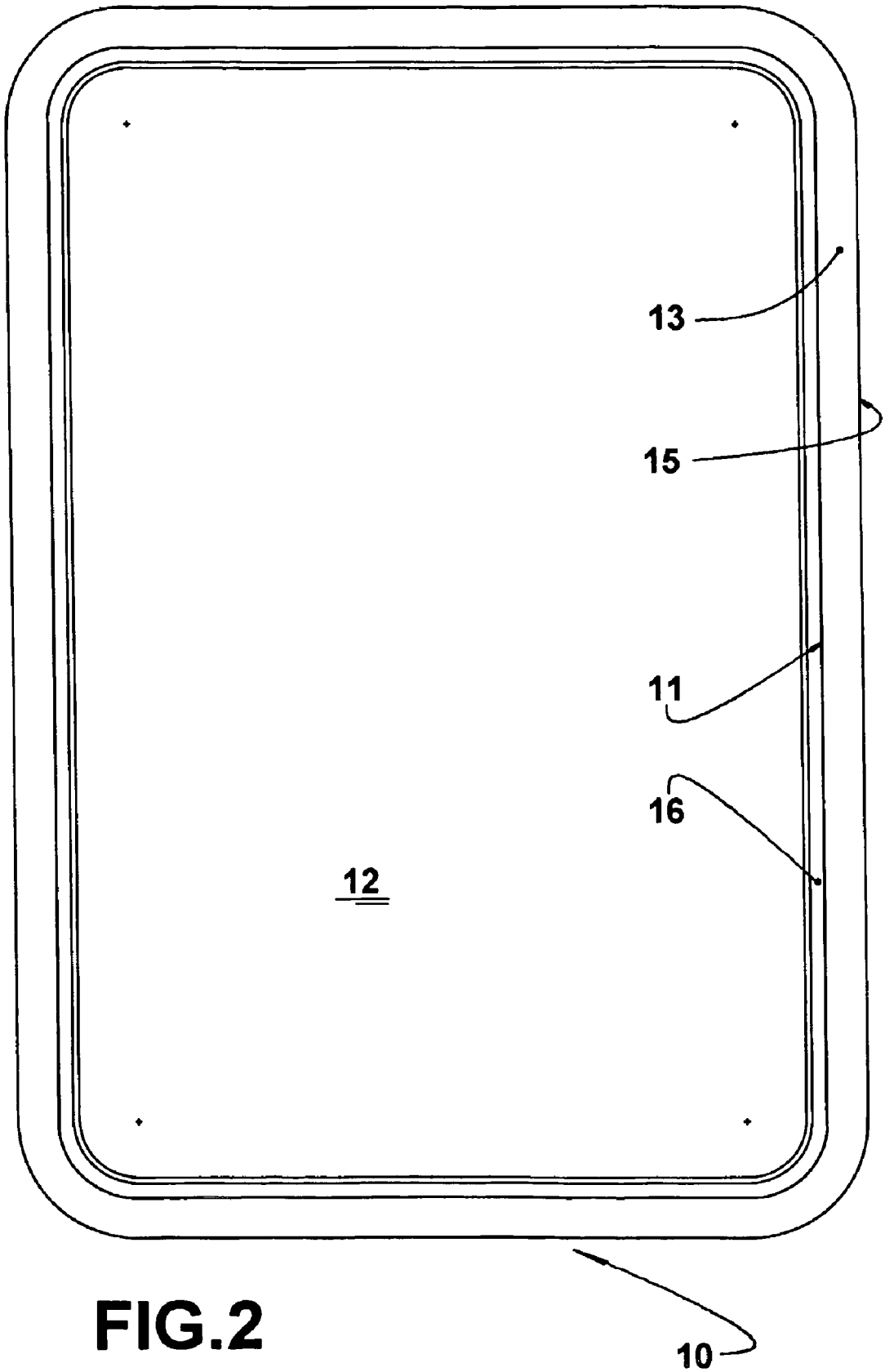
FIG. 2 is an upper plan view of the container of FIG. 1 without the lid.

As illustrated in the figures of the enclosed drawings, the present paint container is of the type which comprises a body 10 with a generally rectangular polygonal cross section and which is defined by a plurality of lateral walls 11, whose lower edges are interconnected by a bottom wall 12 and whose upper edges define respective upper edge portions 13 of the body 10.

The body 10 is preferably constructed in metallic sheet, defining a can with a substantially parallelepipedic contour and which is superiorly opened and dimensioned to store a determined volume of paint.

It should be understood that the body 10 might be constructed in other adequate materials, such as injected plastic. Independently of the material with which the body 10 is made, the latter must present a cross section dimensioned to allow the introduction of a paint instrument, which may be defined by a paint roller or by any brush. In the case of paint containers of the type used for painting construction walls, it is interesting that the body 10 presents a cross section dimensioned to allow a paint roller with a conventional size to be introduced therein.

The present container further comprises a lid 20 which is also constructed in any adequate material, but preferably in injected plastic material, presenting a peripheral contour similar to that defined by the respective upper edge portions 13 of the body 10. The lid 20 presents lateral edge portions 21 which are removably seated and tightly retained in a seat 15 defined along the upper edge portions 13 of the body 10.

According to the construction illustrated in FIGS. 1-5, the distance between at least two opposite lateral walls 11 disposed on both sides of the upper edge portion 13 for the external mounting of the lid 20 is superior to the longitudinal extension of a paint roller.

In the illustrated embodiment, the body 10 presents a cross section which is reduced along at least part of its height, in order to allow the partial fitting of a body 10 inside another body 10 disposed immediately below, and without the lid 20.

Still according to the illustrated embodiment, the reduction of the cross section of the body 10 is at least substantially achieved by means of a peripheral reducing step 16 provided at half the height of the body 10. As it can be noted in the drawings, by reducing the cross section of the lower medium portion of the body 10, it is possible to partially fit a body inside another body when said bodies are shipped to be filled, considerably reducing the stacking volume of said bodies. It should be understood that, besides the cross section reduction obtained by the peripheral reducing step 16, there can be further provided, both in the upper half and in the lower half of the body 10, a slight cross section reduction in the direction from the upper part to the lower part, depending on the way the body is constructed, with the purpose of facilitating its removal from an injecting mold, for example.

According to the present invention, the lid 20 presents a lower face 20*a* incorporating, in an inwardly recessed position in relation to one of its lateral edge portions 21, a support means 22, downwardly projecting and which is configured to be selectively engaged with the adjacent upper edge portion 13 of the body 10 after the opening of the lid 20, so as to maintain the latter with its adjacent lateral edge portion 21 externally seated against the respective lateral wall 11 of the body 10, the lid being thus disposed in a position in which it is inclined upwardly and outwardly from the body 10, with its lower face 20*a* forming a paint drip tray.

Figure 4:
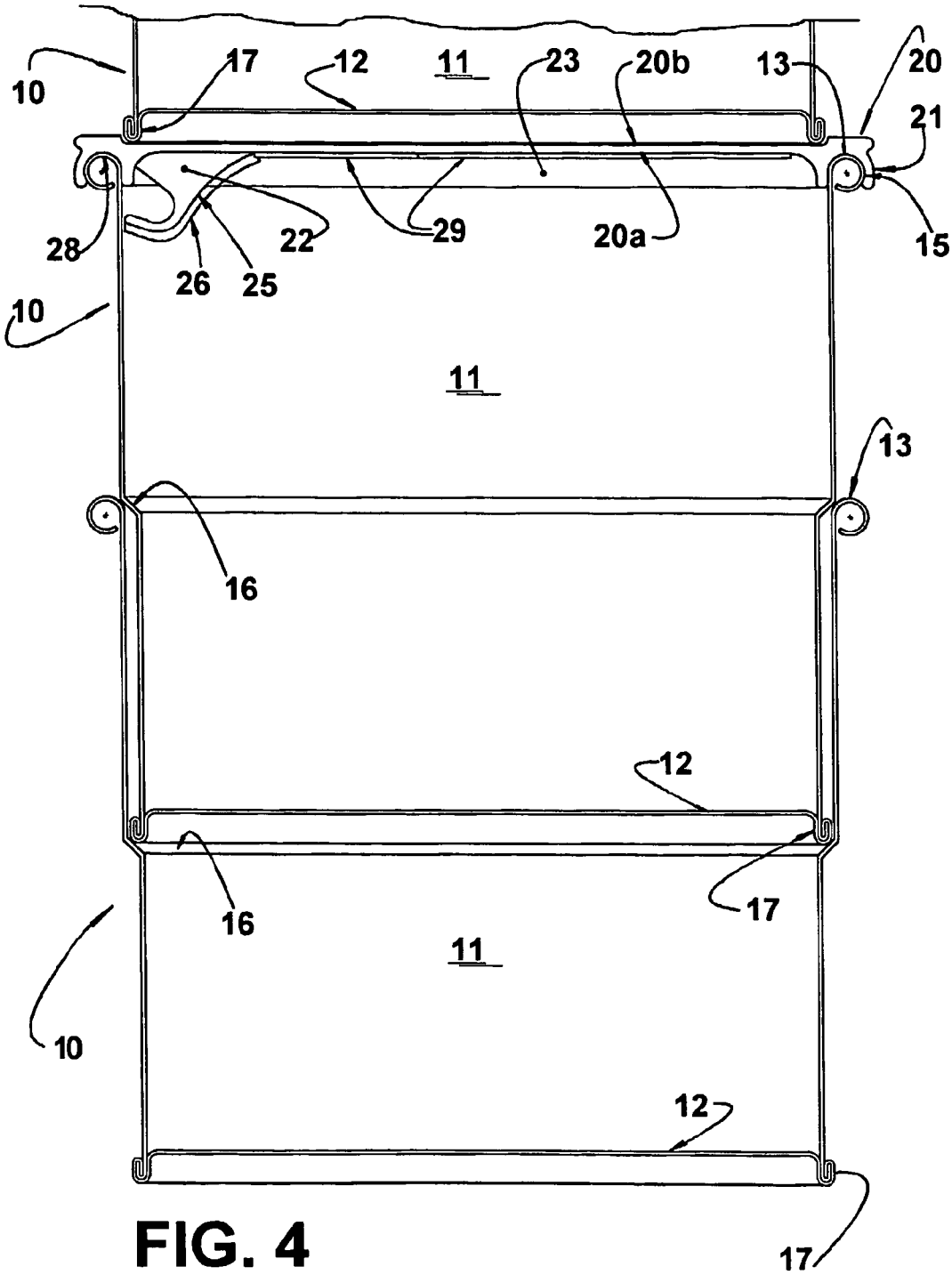
FIG. 4 is a sectional view of the container with the lid in the closed position and illustrating, simultaneously, the partial fitting of a container inside other like container, as well as the stacking of two containers, the section being taken according to line IV-IV in FIG. 1.
Figure 5:
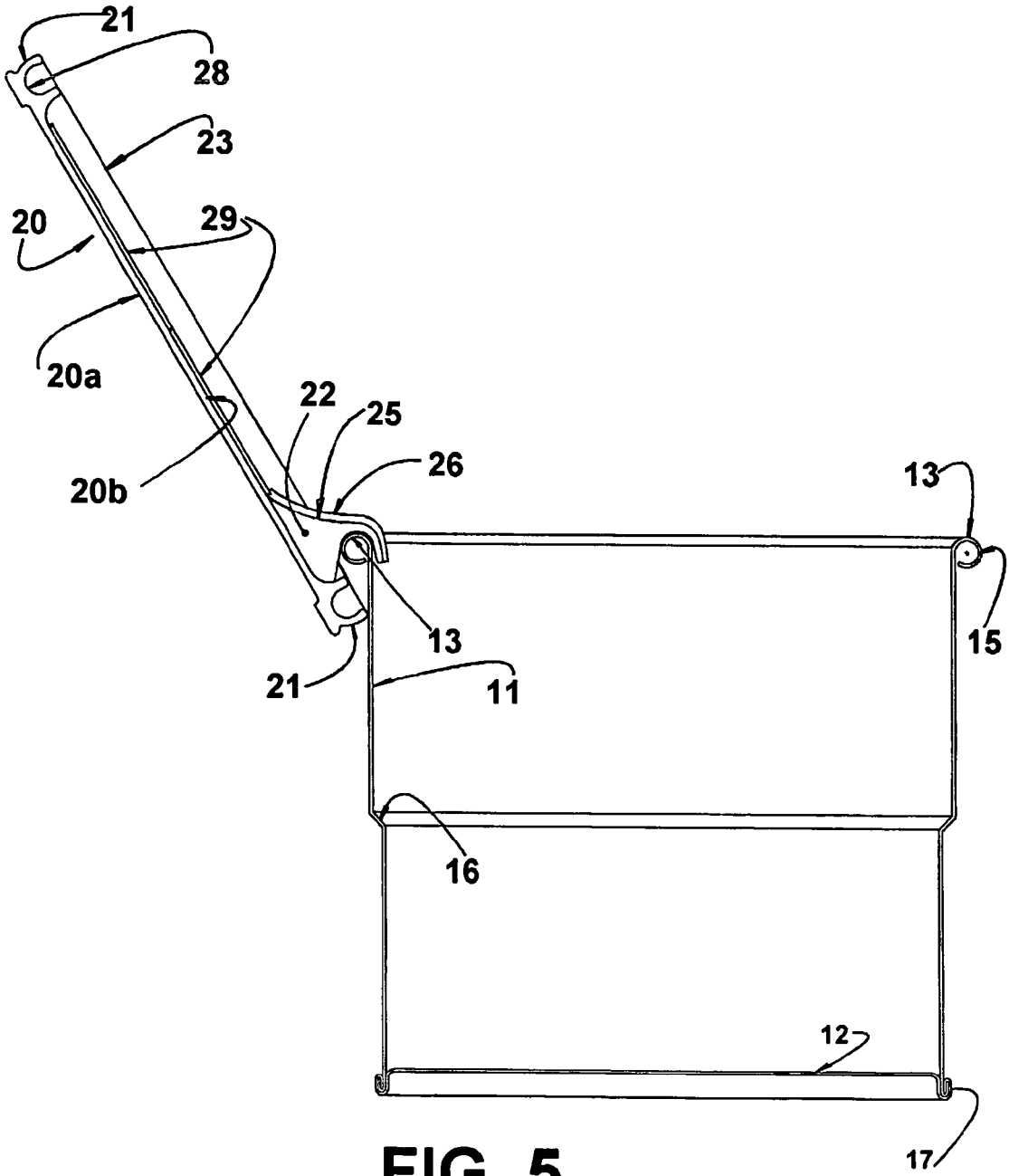
FIG. 5 is a view similar to that of FIG. 4, but illustrating only one container in which the lid is in the open position and externally mounted to one of the lateral walls in order to define a paint drip tray.

The support means 22 is configured to define a deflecting chute 25, whose profile allows the paint, which is gravitationally dripping down the internal face 20*a* of the lid 20, to be directed to the interior of the body 10, flowing over the deflecting chute 25, as better illustrated in FIGS. 4 and 5 of the enclosed drawings.

The internal face 20*a* of the lid 20 is preferably constructed so as to incorporate, close to each lateral edge portion 21, a respective pending skirt portion 23, said pending skirt portions 23 being united to each other in pairs, through the adjacent ends thereof, imparting to the lower face 20*a* of the lid 20 the aspect of a tray which is laterally contained by said pending skirt portions 23, which prevent the excess of paint being removed from the paint roller or from any other painting instrument that is pressed against the inclined lower face 20*a* of the lid 20, from laterally dripping outwardly from the lid 20, not being adequately returned to the interior of the body 10.

In order to prevent the support means 22 from being transformed in an obstacle to the gravitational flow of the excess of paint toward the inside of the body 10, said support means 22 is incorporated to the lid 20 internally and adjacently to one of the pending skirt portions 23, said support means being configured so that the deflecting chute 25 formed thereby remains disposed over the adjacent pending skirt portion 23, as better illustrated in FIGS. 4 and 5.

The support means 22 presents an extension which is substantially equal to that of the adjacent pending skirt portion 23 and incorporates, at each end, a high relief rib 26 which defines an extension of the pending skirt portion 23 disposed on each side of the support means 22. The provision of these lateral end ribs 26 defines means for laterally containing the gravitational flow of the excess of paint also in the region of its flow over the deflecting chute 25, preventing the paint from unduly dripping outwardly from the body 10 of the container.

In the illustrated construction, the lateral edge portions 21 of the lid 20 jointly define a continuous inferior groove 28 which is configured to be seated and retained in the seat 15 of the body 10, the internal lateral wall of said inferior groove 28 being generally defined by a respective pending skirt portion 23.

According to the illustrated construction, the inferior groove 28 presents a partially circular shape in order to be fitted onto a seat 15 defined by a continuous rib with a substantially circular section that is incorporated to the upper edge portions 13 of the body 10. The seat 15 is preferably constructed to project radially outwardly from the contour of the lateral walls 11 of the body 10 in the region of its upper edge portions 13, it being understood, however, that the seat 15 could be constructed in such a way as to project radially outwardly as well as inwardly in relation to the lateral walls 11 of the body 10 in the region of its upper edge portions 13.

The rib which constitutes the seat 15 can be formed in different manners, some of them depending on the material to be used in the formation of the body 10. In a preferred construction, the body 10 of the container is made of metallic sheet, the seat 15 being defined by bending the lateral walls 11 of the body 10, which bending causes the seat 15 to take the form of a tubular rib with a substantially circular cross section, projecting radially outwardly from the contour of the lateral walls 11 of the body 10 in the region of its upper edge portions 13. With this construction, the inferior groove 28 of the lid 20 seats on the seat 15 through the elastic deformation, particularly of its external lateral wall, which has its end portion seated against the surface of the seat 15 disposed below the transversal plane which intersects the seat 15 in its larger cross section region. The type of construction illustrated herein is particularly adequate to a lid 20 made of plastic material. However, it should be understood that similar results could be obtained by making the lid with other materials other than plastic.

The internal face 20*a* of the lid 20 is preferably provided with a plurality of high relief median ribs 29 generally disposed in an inclined arrangement and converging to the center, in order to gravitationally direct the dripping paint to the deflecting chute 25, when the lid 20 is operating as a paint drip tray.

Figure 3:
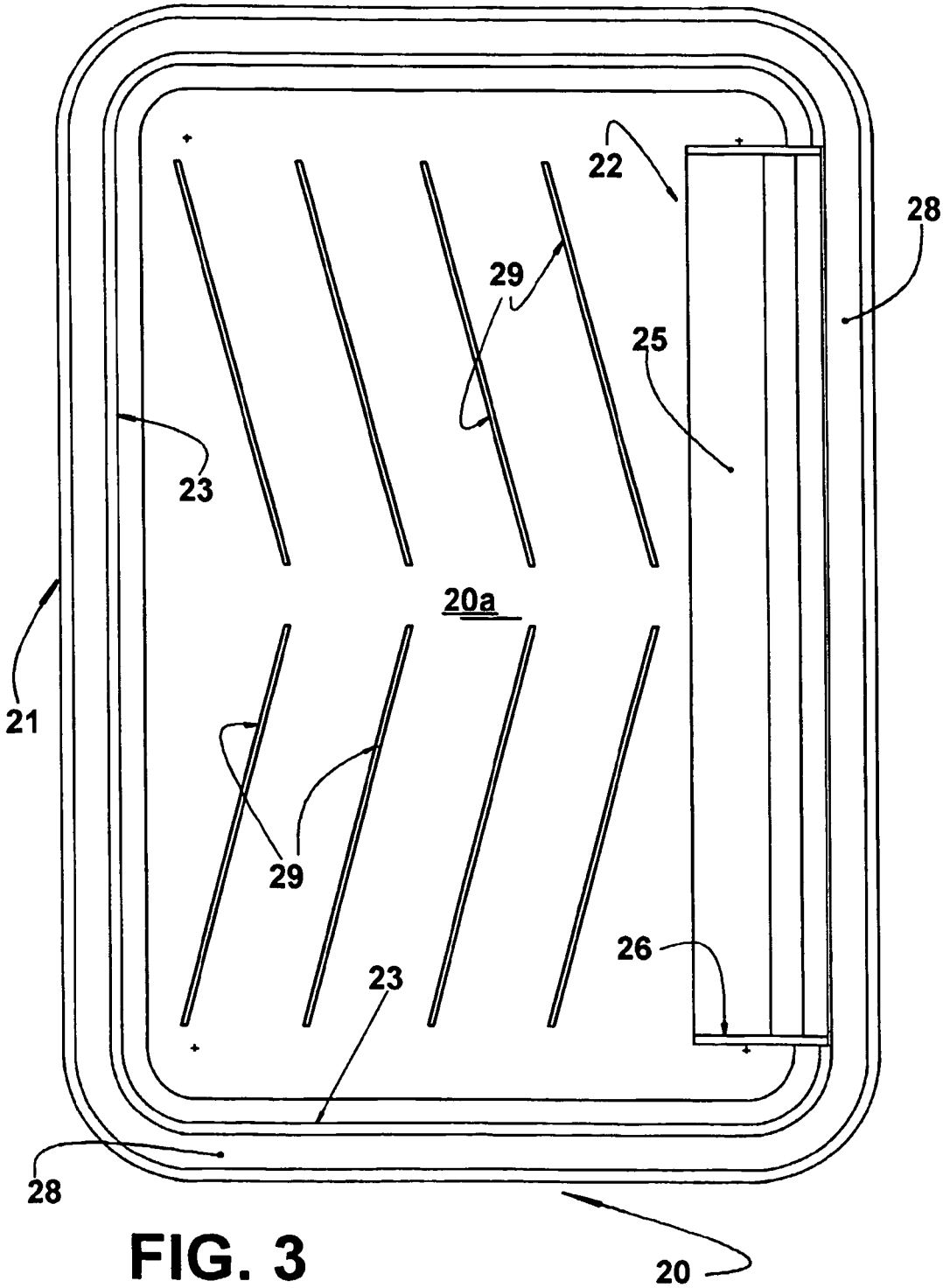
FIG. 3 is a lower plan view of the lid of the container of FIGS. 1 and 2.

As better illustrated in FIGS. 3, 4 and 5, the support means 22 is constructed jointly with the deflecting chute 25, in order to define not only the element to be engaged over the respective extension seat 15 of the body 10, but also a slope, matching the internal face 20*a* of the lid 20 with the internal region of the body 10 over the adjacent upper edge portion 13 of the latter.

As already previously mentioned, the body 10 presents the lower portion thereof with a cross section which is similar but slightly reduced in relation to the cross section of its upper region, allowing the lower peripheral edge 17 of the body 10 to be seated, upon stacking the already filled containers closed by a lid 20, in a median recess 20*b* (see FIG. 4) provided on the upper face of the lid 20, which allows a higher stacking stabilization to be obtained, since it promotes the locking between two consecutive containers, preventing relative transversal displacements therebetween.

While only one preferred embodiment of the present invention has been illustrated herein, it should be understood that changes in the form and arrangement could be made, without departing from the constructive concept defined in the appended claims.

The invention claimed is:

1. A paint container, comprising:

a body having a polygonal cross section and a plurality of lateral walls, the plurality of lateral walls having respective upper edge portions and a seat disposed along the upper edge portions; and a lid having lateral edge portions and a lower face, wherein the lateral edge portions jointly define a continuous inferior groove which is removably seated and tightly retained on the seat, and wherein the lower face includes a deflecting chute and a downwardly projecting support means adapted to engage the seat and disposed at an inwardly recessed position from one of the lateral edge portions, wherein the lid is removable from the body and readaptable thereto at an inverted, inclined position by engaging the downwardly projecting support means and the seat such that one of the lateral edge portions abuts the exterior surface of one of the lateral walls and the deflecting chute extends from the lower face of the lid to the interior of the body, thereby forming a paint drip tray.

2. The container as set forth in claim 1, wherein the lower face of the lid incorporates, close to each lateral edge portion, a respective pending skirt portion, the pending skirt portions being interconnected to form a tray.

3. The container as set forth in claim 2, wherein the support means is incorporated to the lid internally and adjacently to one of the pending skirt portions.

4. The container as set forth in claim 3, wherein the support means has an extension substantially equal to that of the adjacent pending skirt portion.

5. The container as set forth in claim 4, wherein the support means incorporates, at each end, a high relief rib defining an extension of the pending skirt portion disposed on each side of the support means.

6. The container as set forth in claim 2, wherein the pending skirt portions are defined by an internal lateral wall of the inferior groove.

7. The container as set forth in claim 1, wherein the seat is defined by a continuous rib, with a substantially circular cross section, incorporated to the upper edge portions of the body.

8. The container as set forth in claim 7, wherein the seat projects radially outwardly from the contour of the lateral walls of the body in the region of its upper edge portions.

9. The container as set forth in claim 7, wherein the body is made from a metallic sheet, the seat being defined by bending the lateral walls of the body.

10. The container as set forth in claim 7, wherein the inferior groove of the lid presents a cross section similar to that of the seat, seating on the latter by means of the elastic deformation of its external lateral wall.

11. The container as set forth in claim 10, wherein the lid is made of a plastic material.

12. The container as set forth in claim 10, wherein the lower face of the lid incorporates a plurality of high relief median ribs which are disposed in such a way as to gravitationally direct the dripping paint to the deflecting chute when the lid is operating as a paint drip tray.

13. The container as set forth in claim 1, wherein the body has a reduced cross section along at least part of its height, so as to allow a partial fitting of the body inside another body disposed immediately below and without the lid.

14. The container as set forth in claim 13, wherein the reduced cross section is at least substantially obtained by means of a peripheral reducing step provided at half the height of the body.

15. The container as set forth in claim 13, wherein the distance between at least two opposite lateral walls at respective upper edge portions is superior to the longitudinal extension of a paint roller.

* * * * *